United States Patent [19]

Brualdi

[11] 4,083,445

[45] Apr. 11, 1978

[54] RIBBON REVERSAL MECHANISM FOR AN OFFICE MACHINE

[75] Inventor: Giorgio Brualdi, Ivrea (Turin), Italy

[73] Assignee: Ing. C. Olivetti & C., S.p.A., Ivrea (Turin), Italy

[21] Appl. No.: 679,636

[22] Filed: Apr. 22, 1976

[30] Foreign Application Priority Data

May 15, 1975 Italy ..... 68241 A/75

[51] Int. Cl.[2] ..... B41J 33/44

[52] U.S. Cl. ..... 197/161

[58] Field of Search ..... 197/151, 160, 161, 162, 197/163, 164, 165; 101/336

[56] References Cited

U.S. PATENT DOCUMENTS

| | | | |
|---|---|---|---|
| 942,383 | 12/1909 | Kitzmiller | 197/161 |
| 1,309,403 | 7/1919 | Fort | 197/160 |
| 1,461,331 | 7/1923 | Schmidt | 197/161 |
| 1,522,874 | 1/1925 | Ekman | 197/161 |
| 1,702,938 | 2/1929 | Garbell | 197/161 |
| 3,587,813 | 6/1971 | Dugeny et al. | 197/162 |
| 3,602,356 | 8/1971 | Dodsworth | 197/162 |
| 3,633,841 | 1/1972 | Bumgardner | 197/162 X |
| 3,889,795 | 6/1975 | Garberi et al. | 197/161 X |

*Primary Examiner*—Ernest T. Wright, Jr.

*Attorney, Agent, or Firm*—Schuyler, Birch, Swindler, McKie & Beckett

[57] ABSTRACT

A mechanism for reversing the movement of an inked ribbon in an office printing machine or the like comprising first and second rotors each for effecting the rotation of one of two ribbon spools on which the ribbon is mounted and a driving element for alternately imparting a driving force to one of the rotors. The driving element is alternately selectively coupled to one of the two rotors to effect the reversal of the movement of the ribbon. A reversing member is shiftable between a first position wherein the driving element is coupled to the first rotor and a second position wherein the driving element is coupled to the second rotor. The reversing member is resiliently coupled to the driving element for rotational movement therewith. The reversing member is maintained in one of the two positions and is permitted to shift to the other of the two positions in response to the application of a predetermined torque. Ribbon sensing is provided for sensing that a predetermined amount of ribbon is on one spool indicating that reversal is required and application of the predetermined torque is effected when the reversal is required to shift the reversing member whereby the driving element is coupled to the other rotor and reversal is effected.

18 Claims, 4 Drawing Figures

RIBBON REVERSAL MECHANISM FOR AN OFFICE MACHINE

BACKGROUND OF THE INVENTION

The present invention relates to a mechanism for reversing the movement of the inked ribbon of a typewriter or other printing office machine, wherein the ribbon is wound on a pair of spools controlled by a pair of corresponding rotors, and wherein a reversing member is adapted to be shifted under the control of ribbon sensing levers between first and second positions in which drive is imparted to the two rotors respectively.

A reversing mechanism is known wherein the reversing member is constituted by a rocking lever provided with an edge having two inclined surfaces converging towards an apex. A pin carried by a positioning lever co-operates with one of these inclined surfaces under the action of a spring which holds the rocking lever in this way in a first position for feeding the ribbon in a first direction. When a sensing lever bearing against the turns of the spool then acting as a take-up spool senses that this spool is nearly full, it urges the rocking lever to turn towards a second position against the action of the spring in question. The pin has to ride over the apex and, when it does so, the spring urges the pin against the other inclined surface and completes the shifting of the rocking lever into the second position to feed the ribbon in the opposite direction to the first direction. In similar manner, a second sensing lever and the spring shift the rocking lever from the second to the first position for another reversal of the movement when the second sensing lever senses that the other spool is nearly full. The rocking lever is provided with two projections which enable a pawl to rotate the corresponding rotors, in the form of toothed wheels fast with the spools in the respective directions. This mechanism requires the action of the spring of the positioning lever to prevail over that of the pawl. Moreover, in order that that positioning spring may shift the rocking lever, it is necessary for each sensing lever to load the positioning spring during the reversing stage so as to bring the pin over the apex. In this stage, the pressure exerted by the sensing element on the ribbon is considerable, so that the end portions of the ribbon are subjected to unacceptable wear. Moreover, the mechanism is complicated and therefore costly.

In U.S. Pat. No. 3,889,795, there is described an improved mechanism in which the rocking lever is merely unlatched by the sensing levers which do not, therefore, have to generate a large force and bear with little pressure on the ribbon. Moreover, each sensing lever unlatches the rocking lever when it senses that the spool acting as the feed spool is nearly empty and the empty diameter of a spool is more determinate than the full diameter. However, it is necessary, as each reversal takes place, to reload the rocking lever in the sense required for the next reversal and the mechanism which performs this action, driven from the rotor driving the spool acting as take-up spool, adds some additional costs to the structure.

SUMMARY OF THE INVENTION

The main object of the present invention is to provide a reversing mechanism which does not wear out the ribbon and which at the same time is simple and therefore has a low cost of manufacture.

According to the present invention, a mechanism for reversing the movement of an inked ribbon in an office printing machine or the like is provided comprising first and second rotors each for effecting the rotation of one of two ribbon spools on which the ribbon is mounted, a driving element for alternately imparting a driving force to one of the rotors and reversing means for alternately selectively coupling the driving element to one of the two rotors to effect the reversal of the movement of the ribbon. The reversing means comprises a reversing member shiftable between a first position wherein the driving element is coupled to the first rotor and a second position wherein the driving element is coupled to the second rotor, detent means for resiliently coupling the reversing member to the driving element for rotational movement therewith while maintaining the reversing member in one of the two positions and permitting and shifting thereof to the other of the two positions in response to the application of a predetermined torque and ribbon sensing means for sensing that a predetermined amount of ribbon is on one spool indicating that reversal is required. The ribbon sensing means including means for effecting application of the predetermined torque when the reversal is required to shift the reversing member whereby the driving element is coupled to the other rotor and reversal is effected.

BRIEF DESCRIPTION OF THE DRAWING

The invention will be described in more detail, by way of example, with reference to the accompanying drawing in which.

DETAILED DESCRIPTION OF THE PREFERRED EMBODIMENTS

Figure 1:
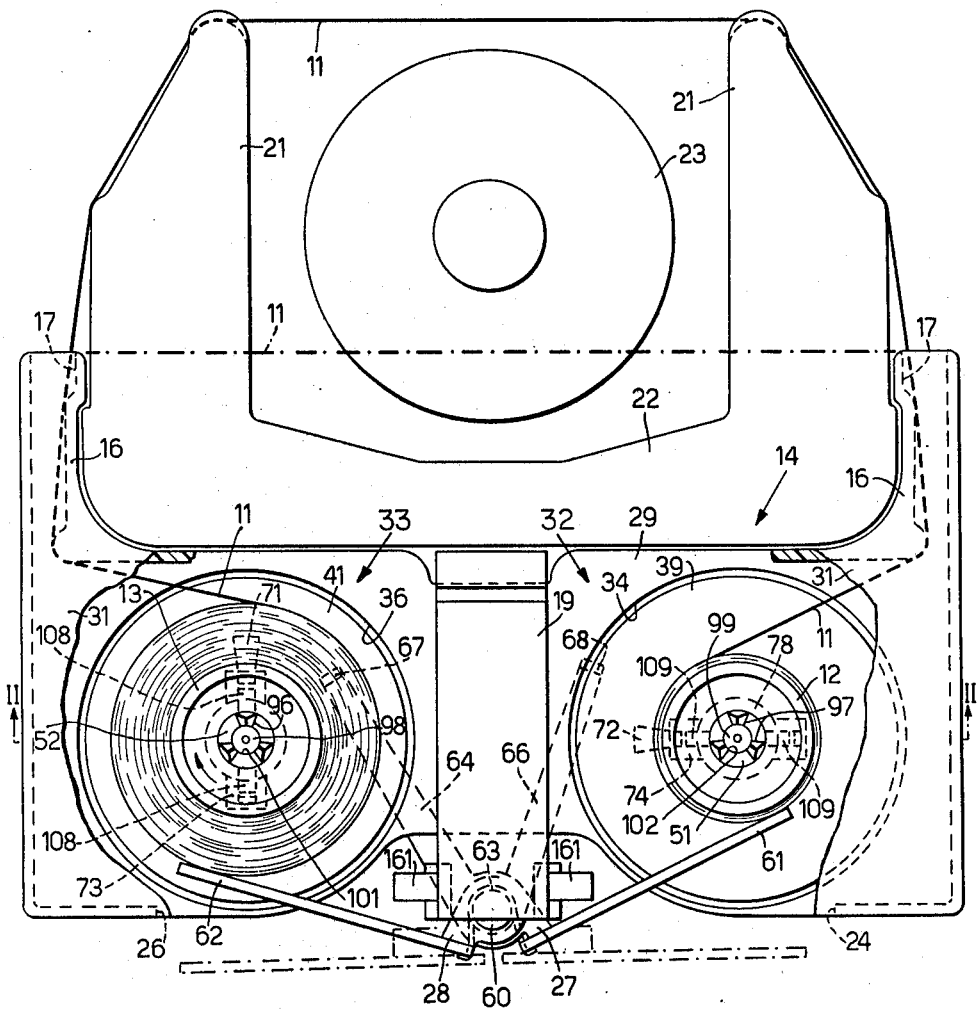
FIG. 1 is a partial plan view of a printing office machine to which the reversing mechanism embodying the invention is fitted.

Referring to FIG. 1, an inked ribbon 11 is wound on a pair of spools 12 and 13 rotatable in a cartridge 14. The cartridge 14 is composed of plastic material in a substantially parallelepipedal shape and is provided on the rear side with two arms 16 having at their ends two apertures 17 for the passage of the ribbon 11 and for supporting the ribbon 11, represented by dashes and lines, when the cartridge 14 is removed from the machine.

Figure 2:
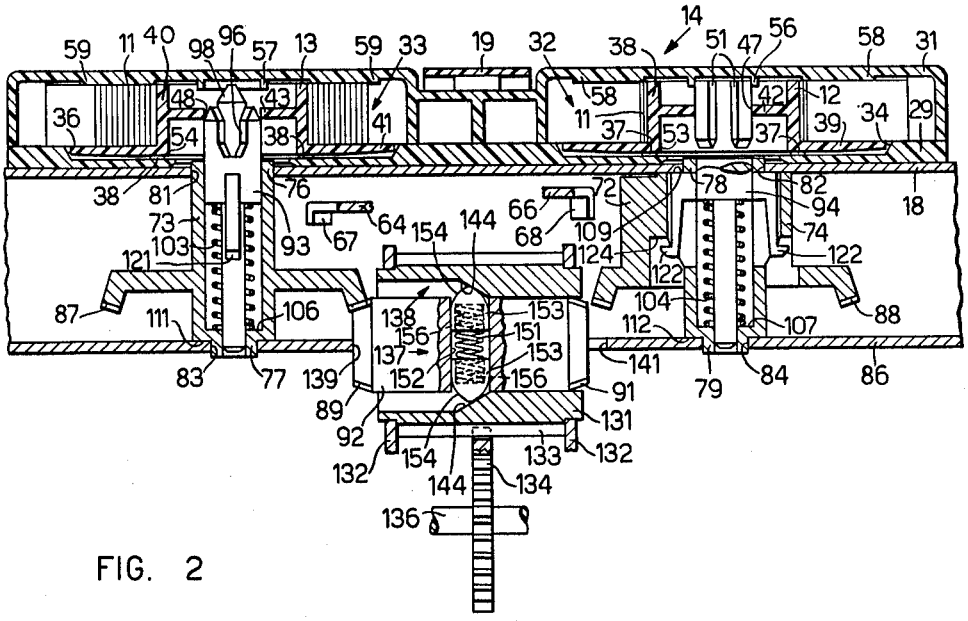
FIG. 2 is a partial section on the line II—II of FIG. 1 showing the reversing mechanism.

The cartridge 14 is mounted on the machine so that it rests on a plate 18 (FIG. 2) and is normally held fixed on the plate 18 by means of a tongue 19 substantially similar to the tongue 77 described in the aforementioned U.S. Pat. No. 3,889,795. A portion of the inked ribbon 11 is then guided and supported by two arms 21 (FIG. 1) of a support 22 fixed to the plate 18 (FIG. 2). The two arms 21 (FIG. 1) embrace a printing head 23 of the machine. The head 23 and the cartridge 14 are movable in known manner for printing a line of print on a platen (not shown in the drawing).

The cartridge 14 is provided at its front side (towards the user of the machine) with two apertures 24 and 26 for permitting the passage of two sensing elements 27 and 28. The cartridge 14 includes a container 29 closed at the top by a cover 31 in such manner as to define two chambers indicated generally by the references 32 and 33 (FIG. 2) in which the spools 12 and 13 are housed.

The container 29 has two frustoconical seats 34 and 36 having three projections 37 and 38, respectively, disposed at 120° from each other on which flanges 39 and 41 of the spools 12 and 13 normally rest.

Each of the spools 12 and 13 is constituted by a cylindrical hub 38 or 40 integral with the flange 39 or 41, respectively, and a ring 42 or 43, respectively, which defines a central hole 47 or 48 surrounded by a toothed rim 51 or 52 (FIG. 1). Each of the toothed rims 51 and 52 has three teeth housed in holes 53 and 54 (FIG. 2), respectively, of the flanges 39 and 41. Therefore, each of the spools 12 and 13 is supported by means of its flange 39 and 41 on the three projections 37 and 38 and is guided at the top by a bushing 56 and 57 on the cover 31. The cover 31 is also provided with a series of ribs 58, 59 which are disposed radially and project towards the spools 12, 13, to guide the ribbon 11 at the top.

Each of the sensing elements 27 and 28 (FIG. 1) can turn on a pivot 60 fixed to the plate 18 (FIG. 2) and comprises an arm or lever 61, 62 (FIG. 1) normally bearing, under the action of a spring 63, against the ribbon 11 wound on the spool 12, 13, respectively. Moreover, each of the sensing elements 27, 28, comprises a second lever 64, 66, having an L-shaped shoulder 67, 68, adapted to move into the path of a cam or stop 71, 72 of a rotor 73, 74 connected to the spool 13, 12.

Each of the rotors 73, 74 (FIG. 2) is journalled by means of two sleeves 76 and 77 and 78 and 79, guided in holes 81 and 82 in the plate 18 and in holes 83 and 84 in a base 86 fixed to the plate 18. Each of the rotors 73, 74 includes a bevel gear 87, 88 adapted to mesh selectively with a bevel gear 89, 91, respectively, the latter gears 89 and 91 being disposed at the ends of a reversing member constituted by a cylinder 92. Moreover, each of the rotors 73, 74 includes a plunger 93, 94, slideable vertically and having its upper end shaped so as to present three notches 96, 97 (FIG. 1) of inverted pyramid form configured to engage with the teeth of the toothed rims 52, 51, respectively, presented by the spools 13 and 12, and a guide pin 98, 99 adapted to engage an internal recess 101, 102 defined by the teeth of the rims 52 and 51.

A spring 103, 104 (FIG. 2) between the plunger 93, 94 and a shoulder 106, 107 of the rotor 73, 74 normally holds the plunger 93, 94 arrested with a shoulder 108 (FIG. 1), 109 (FIG. 2) against a friction surface of the plate 18 and the rotor 73, 74 with a shoulder 111, 112 arrested against the upper surface of the base 86, so as to prevent accidental unwinding of the inked ribbon 11 wound on the spools 13 and 12.

When the rotors 73 and 74 are removed from the machine, the plungers 93 and 94 co-operate by means of two lugs 121 and 122, respectively, with respective shoulders 124 to prevent the springs 103 and 104 from causing the plungers 93 and 94 to emerge from the rotors 73 and 74.

A driving element 131, rotatable in two side pieces 132 of the base 86, is in the form of a hollow cylinder or sleeve with a toothed periphery 133 meshing with a gear 134 on a driving shaft 136.

The cylinder 92 (reversing member) is housed inside the hollow cylinder or sleeve 131 and is axially shiftable therein for selectively engaging the gears 89 and 91 with the gears 87 and 88 respectively. Moreover, the cylinder 92 is rotatable within the cylinder 131 subject to the constraint of a click-stop arrangement formed by a resilient detent device 137 cooperating with a cam structure 138 formed on the inner wall of the hollow cylinder 131. The cam structure 138 is so configured that, in alternate stable positions of the cylinder 92, it is urged axially to the left in FIG. 2, to the position illustrated and in which it is arrested by a stop edge 139 of the base 86, whereas in the intervening stable positions it is urged to the right to a position in which it is arrested against a stop edge 141 with the gear 91 in mesh with the gear 88.

Shifting between the two positions occurs with a snap action when a predetermined resisting torque of the click-stop arrangement is overcome.

Figure 3:
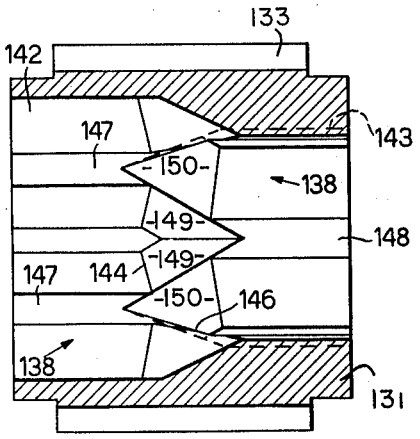
FIG. 3 is a longitudinal section of a detail of FIG. 2 on a larger scale.
Figure 4:
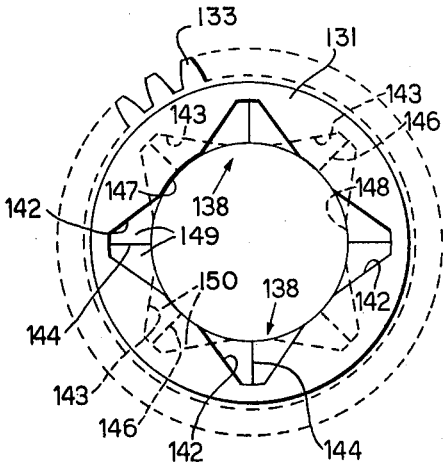
FIG. 4 is a side view of the detail of FIG. 3.

The cam structure 138 (FIGS. 3 and 4) formed on the inner wall of the hollow cylinder 131 comprises two series of peripherally spaced and axially extending grooves 142 and 143, each series having four grooves in the embodiment illustrated. Grooves 142 are rotationally offset relative to grooves 143 so as to be angularly located midway between grooves 143. The lands between the grooves 142 and 143 are arcuately shaped to define cylindrical sectors 147 and 148 conforming to the cylindrical periphery of cylinder 92.

The grooves 142 and 143 extend inwardly from opposite ends of the cylinder 131 and terminate in interdigitated end portions which form click stop recesses or seats 144 and 146 around the annular region of interdigitation. Each seat 144 and 146 has two sloped sides 149 and 150, respectively, which are joined along one edge and which taper inwardly from the inner ends of the respective grooves 142 and 143 to terminate at a point in the cylindrical sectors 147 and 148. In effect, the sloped sides 149 and 150 give a pyramidal-like shape to the seats 144 and 146 with the seats 144 opening to one end of cylinder 131 and seats 146 opening to the opposite end of cylinder 131. Seats 144 and 146 alternate around the cylinder 131 with any given seat 144 being located directly adjacent seats 146 on either side thereof. In addition, the seats 144 and 146 are arranged so that similar seats are disposed opposite to one another.

The resilient detent device 137 (FIG. 2) comprises a spring 151 housed in a transverse throughhole 152 in the reversing member or cylinder 92 and compressed between two diametrically opposed plungers 153 slidable in the hole 152. Each of the two plungers 153 has a domed outer end 154 and a seat 156 in the inner end for containing one end of the spring 151. The spring 151 biases the two plungers 153 to engage two opposite seats 144 (FIG. 4) when the cylinder 92 (FIG. 2) is in the first position and two opposite seats 146 (FIG. 4) when the cylinder 92 (FIG. 2) is in the second position.

The engagement of the spring-biased plungers 153 in the seats 144 or 146 performs two functions. Firstly, it provides the click-stop action for locating the cylinder 92 rotationally in the cylinder 131 and establishes the torque which has to be overcome to click from one stable position to the next. Secondly, the fact that the seats 144, 146 are at tapered end portions of the grooves 142 or 143 establishes an axially directed camming action which urges the cylinder 92 to the left in FIG. 2 when the plungers 153 are in seats 144 and urges the cylinder 92 to the right when the plungers 153 are in seats 146.

As shown in FIG. 2, in the first position the reversing member or cylinder 92 is arrested against the stop 139 and the gear 89 is in mesh with the gear 87. Therefore, the hollow cylinder 131, which is driven from the shaft 136, causes the rotor 73 to rotate clockwise via the cylinder 92, as indicated by the arrow in FIG. 1. As a result, the ribbon 11 unwinds from the spool 12, emerges from the cartridge 14, is guided by the arms 21 and re-enters the cartridge 14, being wound on the spool 13.

By means of the levers 61 and 62, the sensing elements 27 and 28 continuously test the amount of the ribbon 11 wound on the respective spools 12 and 13, being biased by the ends of the spring 63. At a predetermined minimum number of turns of inked ribbon 11 wound on each of the spools 12 and 13 (in the case of FIG. 1 this is the spool 12), the sensing element 27 moves the L-shaped shoulder 67 into the path of the cam 71. The rotor 73 rotates until it is arrested with the cam 71 against the L-shaped shoulder 67, while the sleeve 131 (FIG. 2) continues to rotate. A torque sufficient to overcome the action of the spring 151 is thus created, as a result of which the plungers 153 are compelled to ride up the sides 149 of the two seats 144, compressing the spring 151, until such time as they leave the seats 144 to house themselves in two opposite seats 146 adjoining the seats 144 previously occupied by the plungers 153. As described hereinbefore, the axial camming action of the sides 150 of the seats 146 now biases the cylinder 92 (FIG. 2) into the second position until it is arrested against the stop 141, causing the gear 91 of the cylinder 92 to mesh with the gear 88 of the rotor 74.

In spite of the arrest of the rotor 73 being immediate, the spool 12 does not over-run because of inertia, because the rotor 74 and the plunger 94 are in frictional contact with the surfaces of the base 86 and of the plate 18 owing to the action of the spring 104, as hereinbefore described. The turns of ribbon 11 therefore remain well wound on the spool 12.

The sleeve 131 continues to rotate, so that now it is the rotor 74 that is caused to rotate counter-clockwise in FIG. 1 and the ribbon 11 unwinds from the spool 13 to be wound on the spool 12. The sensing element 27 then turns clockwise and removes the shoulder 67 from the path of the cam 71. In any case, even if the cam 71, which has now reversed its direction of movement, does encounter the shoulder 67, it will not be arrested by this shoulder 67, but will ride out of its path.

Similarly to what has been described hereinbefore in regard to the sensing element 27, at a predetermined minimum number of turns of inked ribbon 11 wound on the spool 13, the sensing element 28 moves the L-shaped shoulder 68 into the path of the cam 72. The rotor 74 rotates until it is arrested with the cam 72 against the L-shaped shoulder 68, while the sleeve 131 (FIG. 2) continues to rotate. A torque overcoming the action of the spring 151 is again created, as a result of which the plungers 153 are compelled to ride up the sides 150 of the two seats 146 (FIG. 3), compressing the spring 151 (FIG. 2), until such time as they leave the seats 146 (FIG. 3) to house themselves in two opposite seats 144. The axial camming action now biases the cylinder 92 into the first position until it is arrested against the stop 139, causing the gear 89 of the cylinder 92 to mesh with the gear 87 of the rotor 73.

It is, therefore, obvious that the driving element 131 is resiliently coupled to the reversing member 92 via the resilient detent device 137 and that the cam structure 138 of the driving element 131 co-operates with the resilient detent device 137 to maintain the cylinder 92 in the first or second position and to transmit the movement from the driving element 131 to the reversing member 92. The cam structure 138 is adapted to shift the point of application of the resilient detent device 137 upon the overcoming of a predetermined resisting torque so as to shift the reversing member 92 with a snap action from the first to the second position and vice versa.

In order to replace a worn out cartridge 14 on the machine by another fresh cartridge 14, the procedure described in the aforementioned U.S. Patent 3,889,795 is as follows: Briefly, by raising the tongue 19 (FIG. 1), the sensing elements 27 and 28 are engaged by pins 161, causing them to turn in opposition to the action of the spring 63, the first clockwise and the second counter-clockwise, thereby disposing them so that they are aligned in the same plane, as shown by the chain-dotted lines in FIG. 1. The worn out cartridge 14 is now lifted out and replaced by another cartridge 14, the latter being rested on the plate 18 (FIG. 2) in such manner as to bring the toothed rims 51 and 52 (FIG. 1) into correspondence with the notches 97 and 96, respectively, but which are not necessarily in alignment with these rims 51 and 52.

The tongue 19 is now swung until it is again disposed in the horizontal position, as shown in FIG. 2, locking the cartridge 14 against the plate 18.

If, by chance, the toothed rims 51 and 52 (FIG. 1) are turned in such manner as to not be coupled with the notches 97 and 96, the rims 51, 52 cause the plungers 94 and 93 (FIG. 2) to be depressed in opposition to the action of the respective springs 104 and 103. As one of the rotors 73 and 74 is rotated by the driving element 131, the plungers 94 and 93 begin to rotate and the notches 97 and 96 (FIG. 1) can then couple up with the rims 51 and 52 under the action of the springs 104 and 103 (FIG. 2).

It is understood that various modifications may be made to the described embodiment without departing from the scope of the claims. For example, the sleeve 131 and the cylinder 92 may be positioned lower than is shown in FIG. 2, the sleeve 131 being axially shiftable and carrying the gears 89 and 91 and the cylinder 92 being axially fixed and driven from the shaft 136. The sleeve 131 then becomes the reversing member and the cylinder 92 becomes the driving element.

While preferred embodiments of the invention have been shown by way of example in the drawing, it will be understood that the invention is in no way limited to these embodiments.

What is claimed is:

1. A mechanism for reversing the movement of an inked ribbon in a printing machine, the mechanism comprising: first and second rotors each for effecting the rotation of one of two ribbon spools on which the ribbon is mounted; a driving element for alternately imparting a driving force to one of said first and second rotors; and reversing means for alternately selectively coupling said driving element to one of said first and second rotors to effect the reversal of the movement of the ribbon, said reversing means comprising a reversing member shiftable between a first position wherein said driving element is coupled to said first rotor and a second position wherein said driving element is coupled to said second rotor, detent means resiliently coupling said reversing member to said driving element for rotating said reversing member by said driving element when said reversing member is loaded up to or below a predetermined torque and for interrupting said coupling between said reversing member and said driving element when said reversing member is loaded more than said predetermined torque causing a reciprocal rotation between said driving element and said reversing member, means for shifting said reversing member from one to the other of said first and second positions in response to said reciprocal rotation; and ribbon sensing means for sensing that a predetermined amount of ribbon is on one ribbon spool indicating that reversal is required and including means for effecting application of said predetermined torque on said reversing member when the reversal is required to shift said reversing member whereby said driving element is coupled to the other rotor and reversal is effected.

2. A mechanism according to claim 1, wherein the detent means include a click-stop mechanism for causing the reversing member to be shiftable with a snap-action between the first and second positions and wherein the click-stop mechanism includes a cam structure which biases the reversing member in the direction of the first position in alternate stable settings of the click-stop mechanism and biases the reversing member in the direction of the second position in the intervening stable settings of the click-stop mechanism.

3. A mechanism according to claim 2, wherein the first and second positions of the reversing member are defined by two respective stops against which the reversing member is biased by the action of the cam structure.

4. A mechanism according to claim 1, wherein the reversing means includes a drive train including said reversing member for coupling rotary movement from the driving element to the first or second rotor, depending upon the position of the reversing member.

5. A mechanism according to claim 3, wherein the reversing member and driving element are two concentric parts of which one is a sleeve having the cam structure on its inner periphery and the other is a cylindrical body rotatable within the sleeve subject to the constraint of the click-stop mechanism, the concentric parts being axially shiftable relative to one another under the action of the cam structure.

6. A mechanism according to claim 5, wherein each rotor includes a bevel gear and one of the concentric parts which constitutes the reversing member has bevel gears on its two ends which engage with either of the bevel gears of the rotors depending upon the position of the reversing member, and the other of the concentric parts is axially fixed.

7. A mechanism according to claim 1, wherein the ribbon sensing means comprises a pair of sensing elements each biased against the ribbon on one of the two ribbon spools.

8. A mechanism according to claim 7, wherein the means for effecting the predetermined torque includes means mounting each sensing element to arrest the rotation of the driven rotor when said each sensing element respectively senses that the ribbon spool acting as feed spool has said predetermined amount of ribbon thereon.

9. A mechanism according to claim 8, wherein said means for effecting the predetermined torque includes a stop on each rotor and wherein each sensing element, when said each sensing element respectively senses that a ribbon reversal is required, moves into the path of the stop on the rotor which is driven from the driving element to arrest said driven rotor and therefore said reversing member.

10. A mechanism for reversing the movement of an inked ribbon in an office printing machine or the like, the mechanism comprising: first and second rotors each for effecting the rotation of one of two ribbon spools on which the ribbon is mounted; a driving element for alternately imparting a driving force to one of said first and second rotors; and reversing means for alternately selectively coupling said driving element to one of said first and second rotors to effect the reversal of the movement of the ribbon, said reversing means comprising a reversing member shiftable between a first position wherein said driving element is coupled to said first rotor and a second position wherein said driving element is coupled to said second rotor, detent means for resiliently coupling said reversing member to said driving element for rotational movement therewith while maintaining said reversing member in one of said two positions and effecting the shifting thereof to the other of said two positions in response to the application of a predetermined torque, and ribbon sensing means for sensing that a predetermined amount of ribbon is on one ribbon spool indicating that reversal is required and including means for effecting application of said predetermined torque when the reversal is required to shift said reversing member whereby said driving element is coupled to the other rotor and reversal is effected, wherein said driving element is a sleeve axially fixed, said reversing member is a cylindrical body rotatable concentrically and shiftable axially within said sleeve, wherein said detent means includes a click-stop mechanism for causing said cylindrical body to be shiftable with a snap-action between said first and second positions, said click-stop mechanism including a cam structure on the inner periphery of said sleeve which axially biases said cylindrical body in the direction of said first position in alternate stable settings of said click-stop mechanism and biases said cylindrical body in the direction of said second position in the intervening stable settings of said click-stop mechanism wherein said first and second positions of said cylindrical body are defined by two respective stops against which said cylindrical body is biased by the action of said cam structure, and wherein said cylindrical body is rotatable within said sleeve subject to the constraint of said click-stop mechanism and said cylindrical body is axially shiftable relative to said sleeve under the action of said cam structure.

11. A mechanism for reversing the movement of an inked ribbon in an office printing machine or the like, the mechanism comprising: first and second rotors each for effecting the rotation of one of two ribbon spools on which the ribbon is mounted; a driving element for alternately imparting a driving force to one of said first and second rotors; and reversing means for alternately selectively coupling said driving element to one of said first and second rotors to effect the reversal of the movement of the ribbon, said reversing means comprising a reversing member shiftable between a first position wherein said driving element is coupled to said first rotor and a second position wherein said driving element is coupled to said second rotor, detent means for resiliently coupling said reversing member to said driving element for rotational movement therewith while maintaining said reversing member in one of said two positions and effecting the shifting thereof to the other of said two positions in response to the application of a predetermined torque, and ribbon sensing means for sensing that a predetermined amount of ribbon is on one ribbon spool indicating that reversal is required and including means for effecting application of said predetermined torque when the reversal is required to shift said reversing member whereby said driving element is coupled to the other rotor and reversal is effected, wherein said detent means includes a click-stop mechanism for causing the reversing member to be shiftable with a snap-action between said first and second positions, said click-stop mechanism having a cam structure which biases said reversing member in the direction of said first position in alternate stable settings of said click-stop mechanism and biases said reversing member in the direction of said second position in the intervening stable settings of said click-stop mechanism, wherein said first and second positions of said reversing member are defined by two respective stops against which said reversing member is biased by the action of said cam structure, wherein said reversing member and said driving element are two concentric parts of which one is a sleeve having said cam structure on its inner periphery and the other is a cylindrical body rotatable within said sleeve subject to the constraint of said click-stop mechanism, said concentric parts being axially shiftable relative to one another under the action of said cam structure, and wherein said cam structure comprises click-stop recesses in said click-stop mechanism around an annular region of an inner periphery of said sleeve, said recesses having bottoms inclined axially of said sleeve in alternate directions around said annular region, and said recesses being engaged by a resiliently acting detent member of said cylindrical body so as both to provide the snap action and the biasing towards said two positions by engagement of said detent member with said inclined bottoms of said recesses.

12. A mechanism according to claim 11, wherein the recesses comprise two sets of grooves having ends interdigitated in the annular region, the grooves of one set extending in one axial direction away from the annular region, the grooves of the other set extending in the other axial direction away from the annular region, and the interdigitated ends tapering out to form the inclined bottoms.

13. A mechanism according to claim 17, wherein the detent means further comprises a plunger protruding from a hole in the cylindrical body and a spring housed in the cylindrical body and biasing the plunger into the protruding position.

14. A mechanism according to claim 11, wherein the detent means comprises two plungers protruding from opposite ends of a diametral hole through the cylindrical body and a spring compressed between the plungers.

15. A mechanism for reversing the movement of an inked ribbon in an office printing machine or the like, the mechanism comprising: first and second rotors each for effecting the rotation of one of two ribbon spools on which the ribbon is mounted; a driving element for alternately imparting a driving force to one of said first and second rotors; and reversing means for alternately selectively coupling said driving element to one of said first and second rotors to effect the reversal of the movement of the ribbon, said reversing means comprising a reversing member shiftable between a first position wherein said driving element is coupled to said first rotor and a second position wherein said driving element is coupled to said second rotor, detent means for resiliently coupling said reversing member to said driving element for rotational movement therewith while maintaining said reversing member in one of said two positions and effecting the shifting thereof to the other of said two positions in response to the application of a predetermined torque, and ribbon sensing means for sensing that a predetermined amount of ribbon is on one ribbon spool indicating that reversal is required and including means for effecting application of said predetermined torque when the reversal is required to shift said reversing member whereby said driving element is coupled to the other rotor and reversal is effected, wherein said ribbon sensing means comprises a pair of sensing elements each biased against the ribbon on one of said two ribbon spools, and said means for effecting the application of said predetermined torque include a stop on each rotor and means mounting each sensing element such that each sensing element moves into the path of said stop on the rotor which is being driven from said driving element to arrest the rotation of said driven rotor when said each sensing element respectively senses that the ribbon spool acting as feed spool has said predetermined amount of ribbon thereon and that a ribbon reversal is required; and wherein each said sensing element comprises two levers fixed together, one of said levers being biased against the ribbon on the ribbon spool on one rotor and the other of said two levers moving into the path of said stop on the other rotor when the ribbon spool on said one rotor has the predetermined amount of ribbon thereon.

16. A mechanism for reversing the movement of an inked ribbon in an office printing machine or the like, the mechanism comprising: first and second rotors each for effecting the rotation of one of two ribbon spools on which the ribbon is mounted; a driving element for alternately imparting a driving force to one of said first and second rotors; and reversing means for alternatively selectively coupling said driving element to one of said first and second rotors to effect the reversal of the movement of the ribbon, said reversing means comprising a reversing member shiftable between a first position wherein said driving element is coupled to said first rotor and a second position wherein said driving element is coupled to said second rotor, detent means for resiliently coupling said reversing member to said driving element for rotational movement therewith while maintaining said reversing member in one of said two positions and effecting the shifting thereof to the other of said two positions in response to the application of a predetermined torque, and ribbon sensing means for sensing that a predetermined amount of ribbon is on one ribbon spool indicating that reversal is required and including means for effecting application of said predetermined torque when the reversal is required to shift said reversing member whereby said driving element is coupled to the other rotor and reversal is effected, and further comprising means for frictionally restraining the rotation of each rotor including a spring, a plunger for each rotor engageable in a hole in a ribbon spool located on said rotor and a fixed plate and wherein said plunger is biased by the spring against a surface of said fixed plate.

17. A mechanism for reversing the movement of an inked ribbon in a printing machine comprising: two spools carrying the ribbon; a pair of sensing elements for sensing the amount of the ribbon on said two spools and indicating that a ribbon reversal is required; a driving element; a rotatable reversing member shiftable between a first and a second position in response to the indication of said sensing elements to drive alternatively said two spools to move the ribbon in opposite directions; means coupling said driving element to said reversing member for the rotation thereof, said coupling means including means for maintaining said reversing member in one of said first or said second positions coupled with said driving element to be rotated thereby when said reversing member is loaded up to or below a predetermined torque to drive one of said two spools, means for causing each of said sensing elements to apply more than said predetermined torque to said reversing member when the ribbon reversal is required thereby releasing said coupling means and causing a reciprocal rotation of said driving element with respect to said reversing member, said coupling means further including means for shifting said reversing member to the other of said first or said second positions in response to said reciprocal rotation thereby coupling said reversing member to the other of said two spools to effect the reversal of movement of said ribbon.

18. A mechanism for reversing the movement of an inked ribbon in a printing machine comprising: first and second rotors for effecting the rotation of first and second spools respectively on which the ribbon is mounted; a rotatable driving element axially fixed out of engagement with said first and second rotors; an axially shiftable reversing member movable between a first position having a driving engagement with said first rotor and a second position having a driving engagement with said second rotor; releaseable detent means for providing a resilient coupling between said reversing member and said driving element when said reversing member is in said first and second positions to thereby effect rotation of said reversing member and said first and second rotors, means for releasing said detent means to interrupt said coupling when ribbon reversal is required; and said detent means further including means for shifting said reversing member between said first and second positions to effect ribbon reversal when said coupling is interrupted.

* * * * *